US005370253A

United States Patent [19]

Kite

[11] Patent Number: 5,370,253

[45] Date of Patent: Dec. 6, 1994

[54] DISPOSABLE CAP

[76] Inventor: Lewis D. Kite, 8323 Wilcrest #13010, Houston, Tex. 77072

[21] Appl. No.: 225,960

[22] Filed: Apr. 8, 1994

[51] Int. Cl.[5] ..... B65D 45/16

[52] U.S. Cl. ..... 215/326; 215/DIG. 2

[58] Field of Search ..... 215/1 R, 246, 251, 297, 215/298, 363, DIG. 2, DIG. 4, 324, 325, 326, 327; 220/200, 890, DIG. 11, DIG. 30

[56] References Cited

U.S. PATENT DOCUMENTS 1,039,268 9/1912 Gadue ..... 215/363
1,711,337 4/1929 Wright ..... 215/326
1,739,582 12/1929 Ellis ..... 215/363

*Primary Examiner*—Allan N. Shoap
*Assistant Examiner*—Nova Stucker
*Attorney, Agent, or Firm*—Jack C. Munro

[57] ABSTRACT

A disposable cap for a fluid container which is constructed totally of sheet material formed of a pair of thin sheets of wax with a thin base sheet being sandwiched therebetween. The size of the sheets of wax are substantially identical and are significantly greater than the periphery of the base sheet forming a peripheral area totally of wax. The thin base sheet is to cover the access opening of a container with this peripheral area to be deformed and pressed tightly against the sidewall of the container forming a temporary closure cap for the access opening of a fluid container.

13 Claims, 1 Drawing Sheet

DISPOSABLE CAP

BACKGROUND OF THE INVENTION

1) Field Of The Invention

The field of this invention relates to closures for test tubes, flasks, vials, and other containers.

2) Description Of The Prior Art

Laboratory containers such as test tubes, flasks, and vials are in continuous use within laboratories. These types of containers are used to collect and combine specimens of different fluids such as blood, urine and the like. A given specimen of blood may be divided amongst several containers with a different test being performed in each container.

At times the test that is being performed requires a certain length of time to evolve before the test is completed. It is desirable that during this time period that the access opening for this container be closed in order to prevent contamination from outside foreign materials that may accidentally enter within the container. This closure in the past has been accomplished by sheets of wax paper which have been used to wrap the opening of these containers with possibly securing of the wax paper in place by means of a rubber band. This closure procedure is cumbersome and time consuming. Additionally removing of this closure when such is desired is also cumbersome and time consuming.

Also such containers frequently require a shaking motion in order to evenly mix the ingredients of the container. It is desirable that the closure for the container to be sufficiently tight so as to prevent leakage during the shaking of the container.

SUMMARY OF THE INVENTION

The structure of the present invention is directed to a disposable cap for the access opening of a container with this disposable cap being constructed of two in number of sheets of wax with a thin base sheet being located therebetween. The size of the base sheet is substantially less than the sheets of wax so there is formed an outer peripheral area that is formed totally of wax. The base sheet is predesigned to be about the same size as the access opening for the container on which it is to be employed. The disposable cap is to be applied to the container with the base sheet covering the access opening and then the peripheral area is to be deformed down against the sidewall of the container and pressed tightly against the sidewall sticking to the sidewall forming a temporary closure preventing entry of foreign material within the container and preventing leakage of the contents of the container exteriorly of the container.

One of the primary objectives of the present invention is to construct inexpensive disposable caps for commonly used laboratory containers such as test tubes, flasks, vials, and the like.

Another objective of the present invention is to construct a disposable cap of totally natural materials that readily biodegrade over a period of time after being discarded after being used.

Another objective of the present invention is to construct a disposable cap which can be easily and quickly applied to the container and also can be easily and quickly removed from the container when such is desired.

Another objective of the present invention is to construct a disposable cap which prevents leakage of the contents of the container even when the container is being shaken to achieve an even mixing of the contents.

Another objective of the present invention is to construct a disposable cap which can be manufactured inexpensively and therefore sold to the ultimate consumer at an inexpensive price.

DETAILED DESCRIPTION OF THE SHOWN EMBODIMENT

Figure 1:
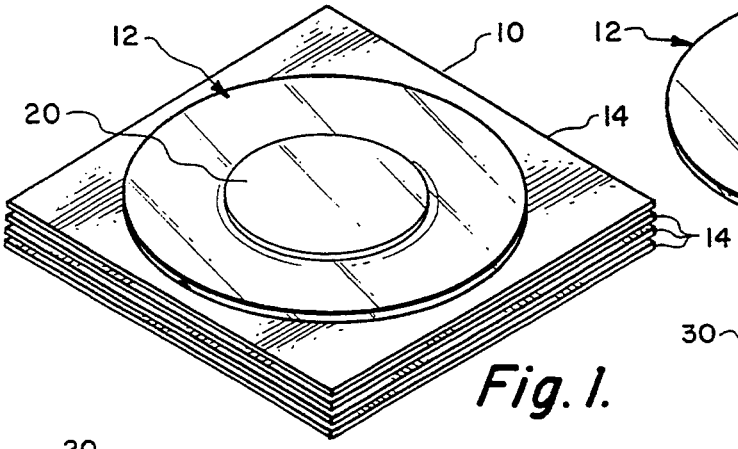
FIG. 1 is an isometric view of a stacked series of the disposable caps of the present invention.

Referring in particular to the drawing there is shown a stack 10 which is composed of a plurality of the disposable caps 12 of this invention. The caps 12 are each in sheet form and are identical. Within the stack 10 there is located a separation paper 14 between each directly adjacent caps 12. Normally the stack 10 will include 10 to 1000 of the caps 12 and be placed in a location that is convenient for the user to extract the uppermost cap 12 and use such. When the uppermost cap 12 is removed, the separation paper 14 located thereunder is immediately removed and discarded exposing the next succeeding cap 12.

Figure 2:
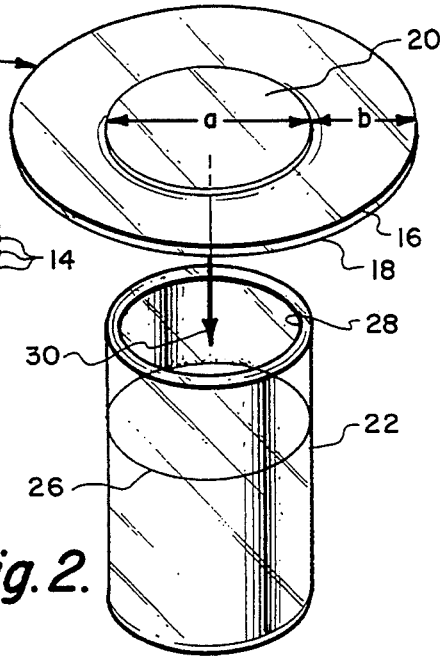
FIG. 2 is an exploded view showing application of a single disposable cap onto a flask type of container in order to close the access opening of the container.

Referring in particular to FIG. 2 it is to be seen that the cap 12 includes a circular center section 20 which constitutes a thin piece of paper or plastic. The diameter of the center section 20 is defined as dimension "a". The portion of the cap 12 that surrounds the center section 20 is defined as the peripheral area and is denoted as dimension "b". The center section 20 is located between two separate wax layers 16 and 18. The wax layers 16 and 18 generally are only a few thousandths of an inch thick. A similar thickness is to be for the center section 20.

Figure 3:
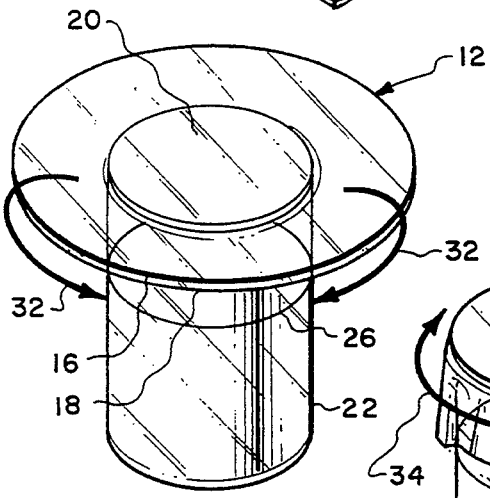
FIG. 3 is an isometric view similar to FIG. 2 but showing the disposable cap being placed in contact with the access opening area of the container.
Figure 4:
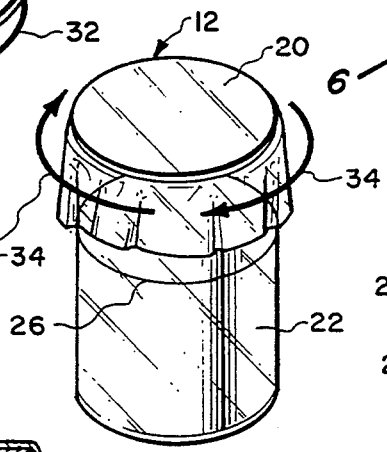
FIG. 4 is a view similar to FIG. 3 but showing the disposable cap being pressed against the sidewall of the container to form a seal.
Figure 5:
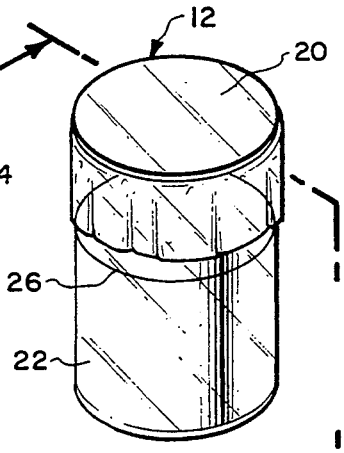
FIG. 5 is a view similar to FIG. 4 but showing the disposable cap in the completely installed position.
Figure 6:
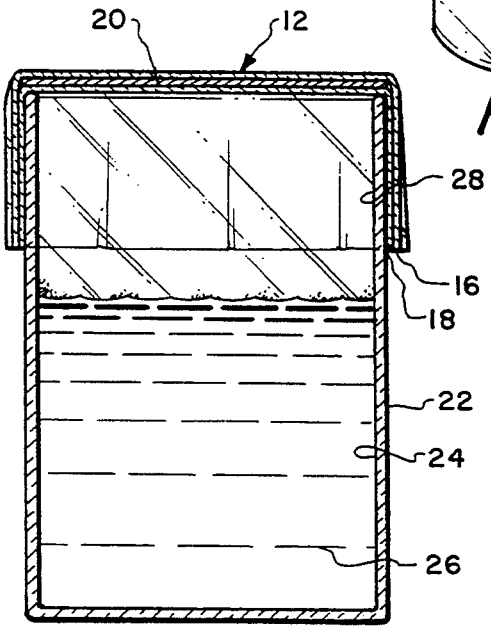
FIG. 6 is a cross-sectional view taken along line 6—6 of FIG. 5.

The diameter "a" is to be preselected to be approximately equal to the access opening 28 of a container 22. Within the container 22 there is to be located a quantity of a fluid such as the liquid 26. The normally open access opening is to be closed by the cap 12 of this invention. The cap 12 is to be removed from the stack 10 and placed over the access opening 28 and moved downward in the direction of arrow 30 locating the central section 20 against and covering the access opening 28. The user then deforms or bends the peripheral area defined by dimension "b" downwardly against the sidewall of the container 26 as is depicted by the arrows 32 in FIG. 3. The user then twists or otherwise presses the peripheral area of the cap 12 into tight contact with the sidewall of the container 22 as is depicted in FIG. 4 by the arrows 34. The disposable cap 12 now assumes a substantially tight, leakage free, closure for the container 22 as is depicted in FIGS. 5 and 6.

Figure 7:
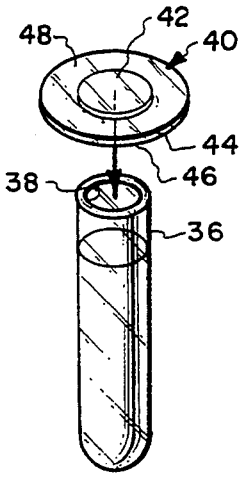
FIG. 7 is a view similar to FIG. 2 but showing a smaller size version of the disposable cap of this invention being applied to a test tube.
Figure 8:
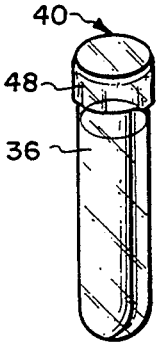
FIG. 8 is a view similar to FIG. 5 showing the small size disposable cap being totally installed on the test tube.

Referring particularly to FIGS. 7 and 8 there is shown a test tube 36 which is substantially smaller in size than the container 22. The test tube 36 has an access opening 38 which is to be closed by means of the disposable cap 40. The disposable cap 40 is substantially smaller in size than the disposable cap 12. Disposable cap 40 has a center section 42 which is designed to just cover the access opening 38. The center section 42 is again to be constructed of sheet material in the form of paper or plastic and is to be located between two layers of wax 44 and 46. The layers 44 and 46 are tightly pressed together completely sealing the center section 42 therebetween as is also the case in conjunction with the cap 12. The cap 40 includes a peripheral area 48 that is to be deformed and pressed tightly against the sidewall of the container 36 as is clearly shown in FIG. 8.

The disposable caps 12 and 40 could also be used as a cap liner for a separate closure cap for a bottle. Normally these closure caps are screwed threadably secured to the bottle. For such bottles, the disposable cap 12 or 40 will be installed in the same manner in conjunction with the container. Then the separate closure cap for the bottle would be placed over the disposable cap 12 or 40 tightly threaded onto the bottle. In that situation the disposable cap 12 and 40 of this invention would be used as a sealing liner to prevent leakage from the bottle relative to the separate closure cap.

What is claimed is:

1. A disposable cap to cover an access opening a fluid container, said fluid container having sidewall, said disposable cap comprising:

a pair of thin sheets of wax located in abutting juxtaposition, said sheets having a peripheral edge; and a thin base sheet, said base sheet being located between said pair of thin sheets of wax and being tightly sealed from the ambient, said base sheet being spaced from said peripheral edge forming peripheral area formed only of said pair of thin sheets of sufficient size to extend downwardly around said container sidewall said disposable cap is to be manually installed over the access opening of the fluid container covering such by said base sheet and then by manually twisting and pressing said peripheral area against said sidewall of said fluid container to form a temporary closure for the access opening.

2. The disposable cap as defined in claim 1 wherein: said thin base sheet being centrally located relative to said sheets of wax.

3. The disposable cap as defined in claim 2 wherein: said pair of thin sheets of wax being the same size.

4. The disposable cap as defined in claim 3 wherein: said pair of thin sheets of wax being circular, said thin base sheet being circular.

5. The disposable cap as defined in claim 4 wherein: said thin base sheet comprising paper.

6. The disposable cap as defined in claim 4 wherein: said thin base sheet comprising plastic.

7. In combination with a container, said container having a sidewall, said container having an internal chamber adapted to contain a fluid, an access opening for providing access into said internal chamber, a disposable cap for said container comprising:

a thin base sheet; and a pair of thin sheets of wax located in abutting juxtaposition, said thin base sheet being located between said pair of sheets of wax and being tightly sealed from the ambient, the planar size of said sheets of wax being greater than the planar size of said base sheet forming a totally wax peripheral area exterior of said base sheet, the planar size of said thin sheets of wax being greater than said access opening, said wax peripheral area to be manually deformed and tightly pressed against said sidewall forming a temporary seal therebetween thereby forming a temporary closure for said access opening.

8. The combination as defined in claim 7 wherein: said thin base sheet being approximately the same size as said access opening.

9. The combination as defined in claim 8 wherein: said thin base sheet being circular, said pair of said thin sheets of wax being circular.

10. The combination as defined in claim 9 wherein: said pair of thin sheets of wax being the same size.

11. The combination as defined in claim 10 wherein: said thin base sheet being centrally located within said pair of thin sheets of wax.

12. The combination as defined in claim 11 wherein: said thin base sheet comprising paper.

13. The combination as defined in claim 11 wherein: said thin base sheet comprising plastic.

* * * * *